US009232834B2

(12) United States Patent
Keyaki et al.

(10) Patent No.: US 9,232,834 B2
(45) Date of Patent: Jan. 12, 2016

(54) SLIDER FOR SLIDE FASTENER WITH AUTOMATIC STOPPER

(75) Inventors: Keiichi Keyaki, Kurobe (JP); Koji Yamagishi, Kurobe (JP); Shinya Honda, Kurobe (JP)

(73) Assignee: YKK Corporation (JP)

( * ) Notice: Subject to any disclaimer, the term of this patent is extended or adjusted under 35 U.S.C. 154(b) by 333 days.

(21) Appl. No.: 13/824,565

(22) PCT Filed: Sep. 24, 2010

(86) PCT No.: PCT/JP2010/066603

§ 371 (c)(1),
(2), (4) Date: Jun. 17, 2013

(87) PCT Pub. No.: WO2012/039065

PCT Pub. Date: Mar. 29, 2012

(65) Prior Publication Data

US 2013/0255042 A1 Oct. 3, 2013

(51) Int. Cl.
*A44B 19/26* (2006.01)
*A44B 19/30* (2006.01)

(52) U.S. Cl.
CPC ..... *A44B 19/26* (2013.01); *A44B 19/308* (2013.01); *Y10T 24/2588* (2015.01)

(58) Field of Classification Search
CPC .. A44B 19/26; A44B 19/308; Y10T 24/2588; Y10T 24/2577; Y10T 24/2561; Y10T 24/2566
USPC ..... 24/418–425
See application file for complete search history.

(56) References Cited

U.S. PATENT DOCUMENTS 3,574,247 A * 4/1971 Jakob ..... 24/430
4,233,099 A * 11/1980 McGuire ..... 156/242
4,624,032 A * 11/1986 Ishii et al. ..... 24/429

(Continued)

FOREIGN PATENT DOCUMENTS

CA 1288582 A 9/1991
CN 1410017 A 4/2003

(Continued)

OTHER PUBLICATIONS

Office Action, Chinese Patent Application No. 201080070355.8, mailed Jan. 15, 2015.

(Continued)

*Primary Examiner* — Robert J Sandy
*Assistant Examiner* — Matthew Sullivan
(74) *Attorney, Agent, or Firm* — Kilpatrick Townsend & Stockton LLP

(57) ABSTRACT

A slider for a slide fastener with an automatic stopper, includes a body forming an element guide passage into which fastener elements are insertable, a locking member swingably supported in the body by a pin and having a locking claw which is protrudable from a locking window hole formed in the body to the element guide passage and an urging member configured to urge the locking member so that the locking claw protrudes from the locking window hole to the element guide passage. A pair of lateral plate portions of the cover, which are disposed at both end portions of the pin are respectively provided with crimping protrusions which are abuttable against end faces of the pin and which are arranged at peripheral portions of a through-hole of the pair of lateral plate portions through which the pin penetrates.

9 Claims, 15 Drawing Sheets

(56) References Cited

U.S. PATENT DOCUMENTS

| | | | | |
|---|---|---|---|---|
| 4,780,938 | A * | 11/1988 | Ishii | 24/429 |
| 4,829,638 | A * | 5/1989 | Ishii | 24/421 |
| 4,982,479 | A | 1/1991 | Oda | |
| 5,068,950 | A * | 12/1991 | Yuki | 24/429 |
| 6,654,988 | B1 * | 12/2003 | Chung | 24/421 |
| 7,207,092 | B2 * | 4/2007 | Iwase et al. | 24/421 |
| 7,219,402 | B2 * | 5/2007 | Yamazaki | 24/429 |
| 8,963,387 | B2 * | 2/2015 | Yasuda et al. | 310/68 B |
| 2003/0056342 | A1 | 3/2003 | Iwase et al. | |
| 2005/0022346 | A1 * | 2/2005 | Wang | 24/429 |
| 2008/0229555 | A1 | 9/2008 | Keyaki et al. | |

FOREIGN PATENT DOCUMENTS

| | | | |
|---|---|---|---|
| CN | 101268884 | A | 9/2008 |
| CN | 101422288 | A | 5/2009 |
| EP | 273324 | A1 | 7/1988 |
| EP | 1295542 | A2 | 3/2003 |
| EP | 1972225 | A2 | 9/2008 |
| JP | 62-243983 | | 10/1987 |
| JP | 2-213302 | | 8/1990 |
| JP | 4-32974 | Y2 | 8/1992 |
| JP | 7-322546 | A | 12/1995 |
| JP | 2003-083309 | | 3/2003 |
| JP | 2003-93116 | A | 4/2003 |
| JP | 2008-229002 | A | 10/2008 |
| TW | 200916012 | A | 4/2009 |

OTHER PUBLICATIONS

International Preliminary Report on Patentability, PCT Application No. PCT/JP2010/066603, mailed Apr. 16, 2013.

Office Action, Japanese Patent Application No. 2012-534900, mailed Oct. 8, 2013.

International Search Report, PCT Application No. PCT/JP2010/066603, mailed Dec. 14, 2010.

* cited by examiner

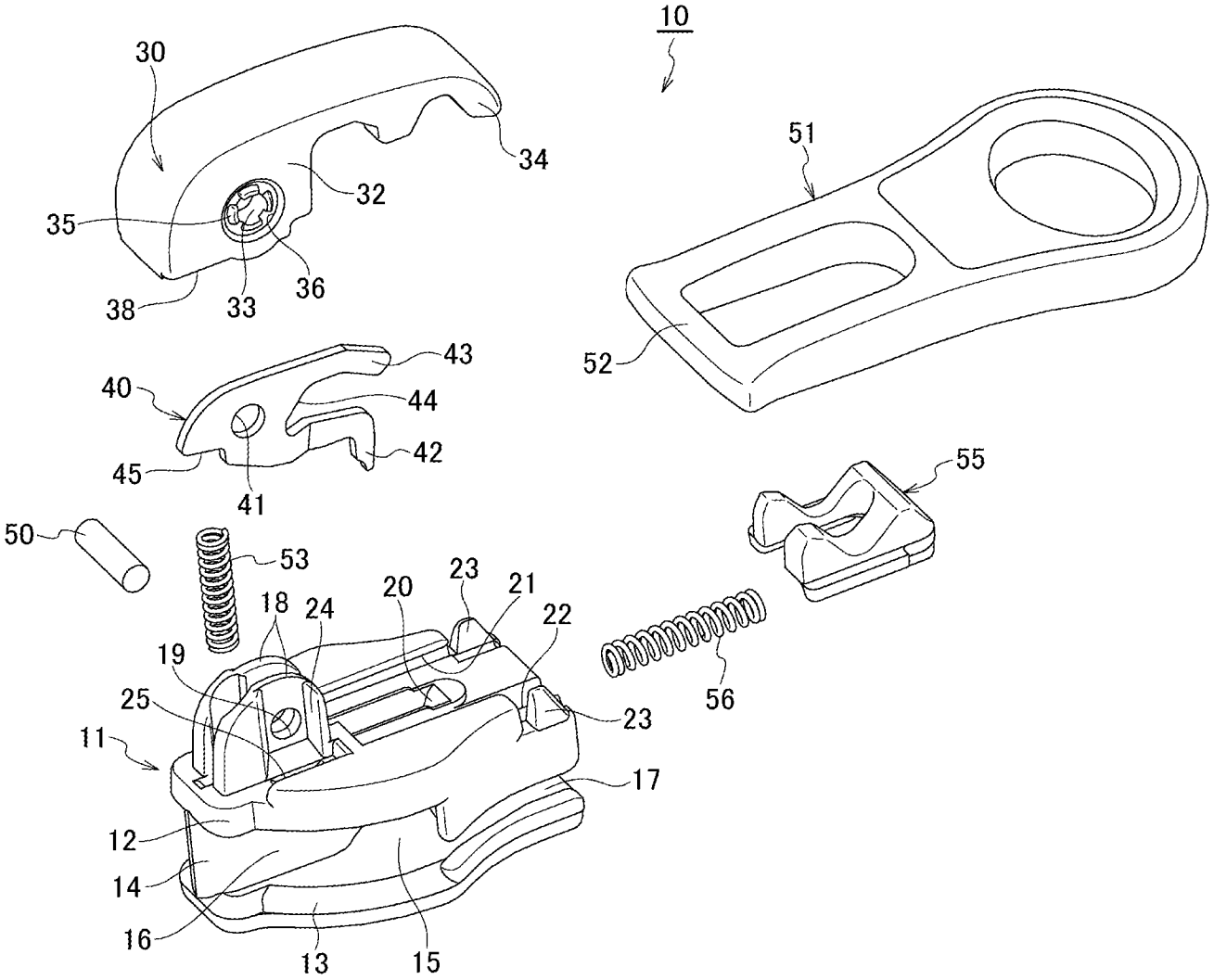
FIG.2
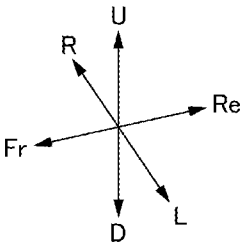

SLIDER FOR SLIDE FASTENER WITH AUTOMATIC STOPPER

This application is a national stage application of PCT/JP2010/066603 which is incorporated herein by reference.

TECHNICAL FIELD

The present invention relates to a slider for a slide fastener with an automatic stopper.

BACKGROUND ART

In a slider for a slid fastener with an automatic stopper, a locking member is swingably supported by a pin, and in a normal condition, a locking claw of the locking member protrudes into an element guide passage by a spring member which urges the locking member. The locking claw is locked between adjacent fastener elements in the element guide passage to lock a slider. Further, if a pull tab is drawn up, the locking claw is lifted up against the urging of the spring member to unlock the slider (e.g., Patent Documents 1 and 2).

Patent Document 1 discloses a slider for the slide fastener with the automatic stopper, to which a pull tab is to be attached after the slider has been assembled. In the slider described in Patent Document 1, a front end of the pin is machined with a recess portion in advance, and after the pin is inserted into a body, the locking member and a cover, the front end of the pin is widened by crimping to lock the pin to the cover. Further, in the slider for the slide fastener with the automatic stopper disclosed in Patent Document 2, after the pin is inserted into the body and the locking member, a curved inclined surface formed on a peripheral portion of a through-hole of the body is bent inwardly to lock the pin.

PRIOR ART DOCUMENT

Patent Document

Patent Document 1: Japanese Utility Model Application Publication No. 4-032974A

Patent Document 2: Japanese Patent Application Publication No. 2-213302A

SUMMARY OF INVENTION

Problems to be Solved by Invention

In the slider for the slide fastener with the automatic stopper disclosed in Patent Document 1, however, since the front end of the pin is necessarily machined, secondary machining is required after a wire is cut. Also, in the slider for the slide fastener with the automatic stopper disclosed in Patent Document 2, the fixation of the pin can be applied to only an application in which the peripheral portion of the through-hole is formed with the curved inclined surface, and cannot be applied to an application in which the peripheral portion of the through-hole is formed in flat.

The present invention has been made in view of the above-described problem, and an object of the present invention is to provide a slider for a slide fastener with an automatic stopper which can decrease a manufacture cost of a pin and also lock a pin irrespective of a shape of a peripheral portion of a through-hole.

Means for Solving Problems

The above object of the present invention can be achieved by the following configuration.

(1) A slider for a slide fastener with an automatic stopper, the slider including: a body forming an element guide passage into which fastener elements are insertable; a locking member swingably supported in the body by a pin, and having a locking claw which is protrudable from a locking window hole formed in the body to the element guide passage; and an urging member configured to urge the locking member so that the locking claw protrudes from the locking window hole to the element guide passage, wherein a pair of lateral plate portions disposed at both end portions of the pin are respectively provided with crimping protrusions, which are abuttable against end faces of the pin and which are arranged at peripheral portions of a through-hole of the pair of lateral plate portions, through which the pin penetrates.

(2) The slider for the slide fastener with the automatic stopper, according to (1), wherein the pair of lateral plate portions are formed with recess portions at the peripheral portions of the through-hole, the recess portions in which the crimping protrusions extend.

(3) The slider for the slide fastener with the automatic stopper, according to (1) or (2), wherein the body includes an upper blade and a lower blade which are connected to each other by a guide post, wherein a cover is attached to the upper blade of the body, the cover which the pin is inserted through together with a pair of attachment pieces erected from the upper blade and the locking member and which covers the pair of attachment pieces and the locking member, and wherein the crimping protrusions are respectively provided on the pair of lateral plate portions of the cover.

(4) The slider for the slide fastener with the automatic stopper, according to (3), wherein the pair of lateral plate portions of the cover are provided with a pair of thick-walled portions which protrude inwardly, at inside surfaces thereof in the vicinity of the through-hole.

(5) The slider for the slide fastener with the automatic stopper, according to (4), wherein the pair of attachment pieces are respectively formed with a pair of depression portions which face the pair of thick-walled portions and which are arranged in the vicinity of a through-hole of the pair of attachment pieces, into which the pin is inserted.

(6) The slider for the slide fastener with the automatic stopper, according to any one of (3) to (5), wherein the cover is formed in a concave shape directed downward, wherein the locking member comprises an operating groove for accommodating an attachment shaft portion of a pull tab therein, wherein the slider comprises a closure member configured to slide between a gap opening position in which an insertion gap formed between a rear mouth-side end portion of the cover and the upper blade is opened and the attachment shaft portion of the pull tab is insertable into the insertion gap, and a gap closing position in which the insertion gap is closed, and wherein the pull tab is configured to be detachable.

(7) The slider for the slide fastener with the automatic stopper, according to (1) or (2), wherein the crimping protrusions are directly provided on the pair of lateral plate portions of the body, respectively.

(8) The slider for the slide fastener with the automatic stopper, according to any one of (1) to (7), wherein the crimping protrusions are formed along edge portions of the through-hole.

(9) The slider for the slide fastener with the automatic stopper, according to any one of (1) to (8), wherein each of the pair of lateral plate portions is provided with at least two crimping protrusions.

(10) The slider for the slide fastener with the automatic stopper, according to any one of (1) to (8), wherein the crimping protrusions are formed over the whole circumferences of the through-hole.

Advantageous Effects of Invention

According to the slider for the slide fastener with the automatic stopper of the present invention, the pair of lateral plate portions which are disposed at both end portions of the pin are respectively provided with the crimping protrusions, which are abuttable against the end surfaces of the pin, at the peripheral portions of the through-hole through which the pin penetrates. Therefore, secondary machining is not required for the pin, and thus a manufacture cost of the pin can be decreased. Further, the pin can be caught irrespective of the shape of the peripheral portions of the through-hole.

BRIEF DESCRIPTION OF DRAWINGS

FIG. 2 is an exploded perspective view of the slider in FIG. 1;

FIGS. 7A and 7B are enlarged perspective views illustrating major parts of a slider for a slide fastener with an automatic stopper, to which a pull tab is to be attached after the slider has been assembled, according to a first modification of the first embodiment, in which FIG. 7A illustrates a state before crimping protrusions are crimped, and FIG. 7B illustrates a state after the crimping protrusions are crimped;

FIGS. 9A and 9B are enlarged perspective views illustrating major parts of a slider for a slide fastener with an automatic stopper, to which a pull tab is to be attached after the slider has been assembled, according to a second modification of the first embodiment, in which FIG. 9A illustrates a state before a crimping protrusion is crimped, and FIG. 9B illustrates a state after the crimping protrusion is crimped;

FIGS. 10A and 10B are enlarged perspective views illustrating major parts of a slider for a slide fastener with an automatic stopper, to which a pull tab is to be attached after the slider has been assembled, according to a third modification of the first embodiment, in which FIG. 10A illustrates a state before a crimping protrusion is crimped, and FIG. 10B illustrates a state after the crimping protrusion is crimped;

EMBODIMENTS OF INVENTION

Figure 1:
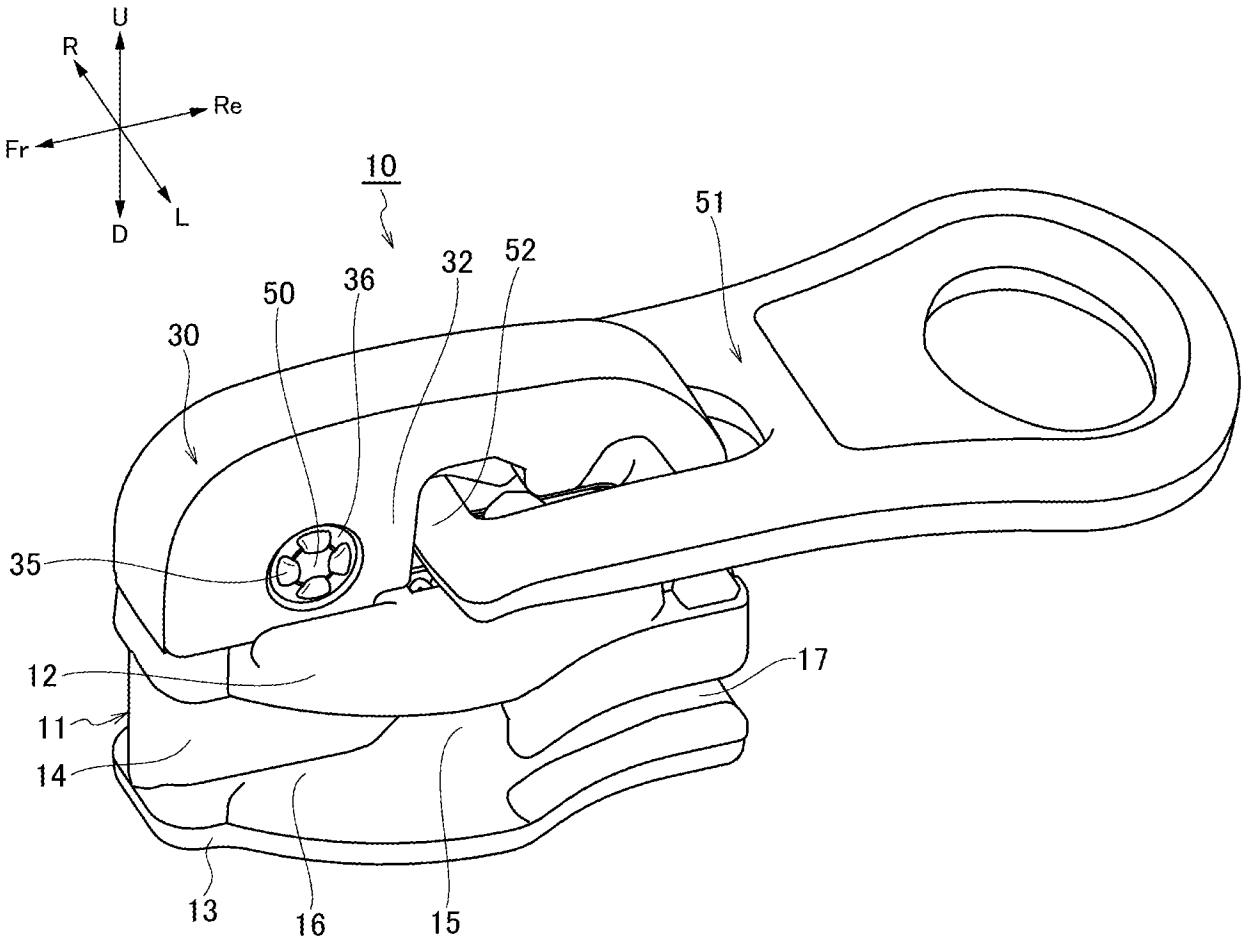
FIG. 1 is a perspective view illustrating a slider for a slide fastener with an automatic stopper, to which a pull tab is to be attached after the slider has been assembled, according to a first embodiment of the present invention.

Each embodiment of a slider for a slide fastener with an automatic stopper, to which a pull tab is to be attached after the slider has been assembled, according to the present invention will now be described in detail with reference to the accompanying drawings. In the following description, as for the slider, an upper side refers to an upper side with respect to the paper surface of FIG. 3, a lower side refers to a lower side with respect to the paper surface of FIG. 3, a front side refers to a left side with respect to the paper surface of FIG. 3, a rear side refers to a right side with respect to the paper surface of FIG. 3, a left side refers to a near side with respect to the paper surface of FIG. 3, and a right side refers to a far side with respect to the paper surface of FIG. 3. Further, in each drawing, reference numeral U indicates the upper side, D indicates the lower side, Fr indicates the front side, Re indicates the rear side, L indicates the left side, and R indicates the right side.

Embodiment 1

First, a slide for a slide fastener with an automatic stopper, to which a pull tab is to be attached after the slider has been assembled, according to the first embodiment will now be described with reference to FIGS. 1 to 7B.

A slider 10 (hereinafter, referred to as a slider 10) for the slide fastener with the automatic stopper, to which the pull tab is to be attached after the slider has been assembled, includes a body 11, an upper blade 13 and a lower blade 13 which are disposed in parallel while being spaced apart from each other in an upward and downward direction, and a guide post 14 for connecting the upper blade 12 and the lower blade 13. An element guide passage 15 is formed between the upper blade 12 and the lower blade 13, and fastener elements (not illustrated) can be inserted into the element guide passage 15.

The element guide passage 15 is communicated in the forward and backward direction of the body 11, and has a shoulder mouth 16 disposed at a wide front end side of the upper blade 12 (lower blade 13), out of which the fastener elements come in a disengaged state, and a rear mouth 17 disposed at a narrow rear end side of the upper blade 12 (lower blade 13), out of which the fastener elements come in an engaged state.

In the following description, a direction (sliding direction of the slider 10) in which the shoulder mouth 16 and the rear mouth 17 are connected to each other is referred to as the forward and rearward direction, a direction (width direction of the slider) perpendicular to the forward and rearward direction is referred to as the left and right direction, and a direction perpendicular to the forward and rearward direction and the left and right direction is referred to as an obverse and reverse direction.

Figure 3:
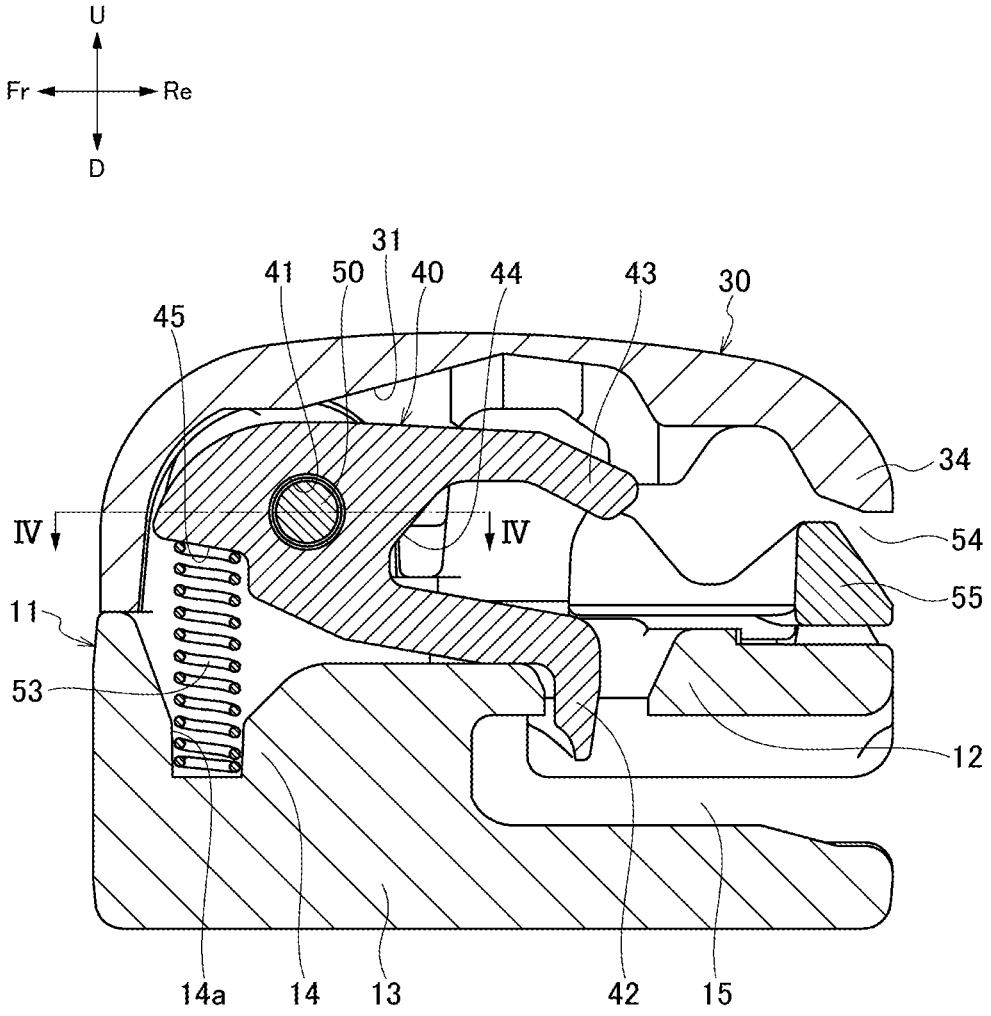
FIG. 3 is a cross-sectional view illustrating a state in which a pull tab is not mounted on the slider in FIG. 1.
Figure 4:
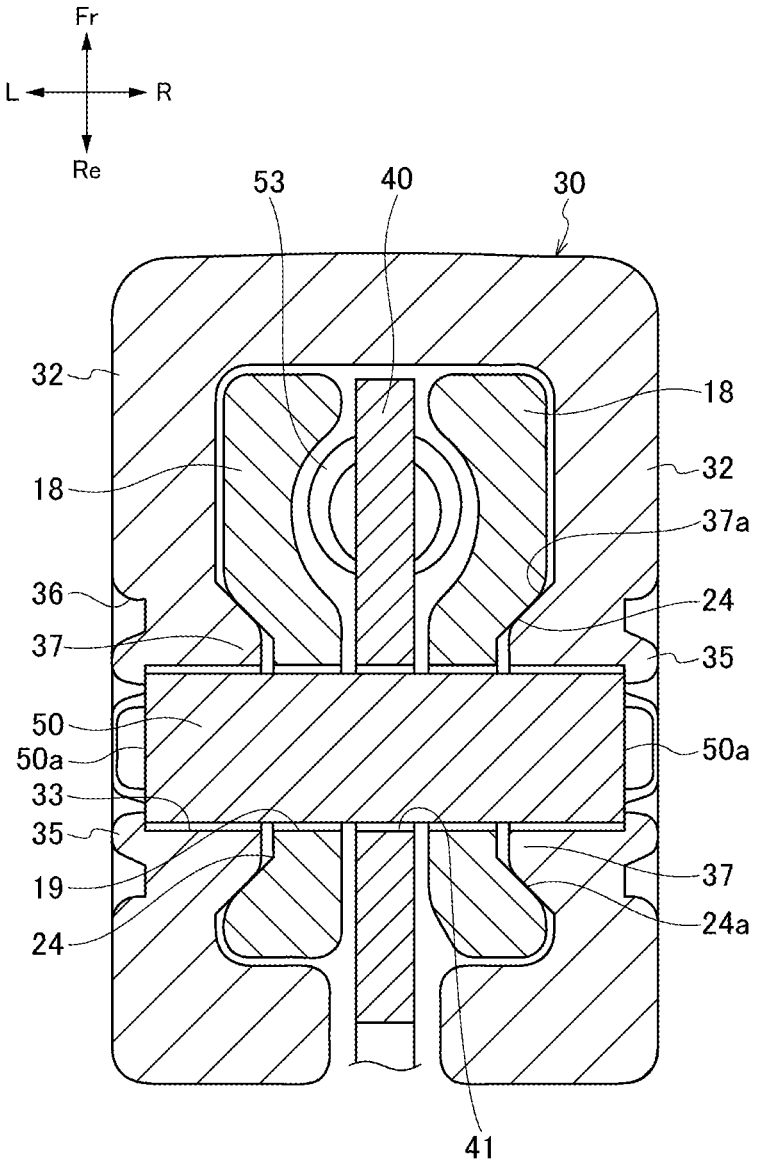
FIG. 4 is a cross-sectional view taken along the line IV-VI in FIG. 3.
Figure 5A:
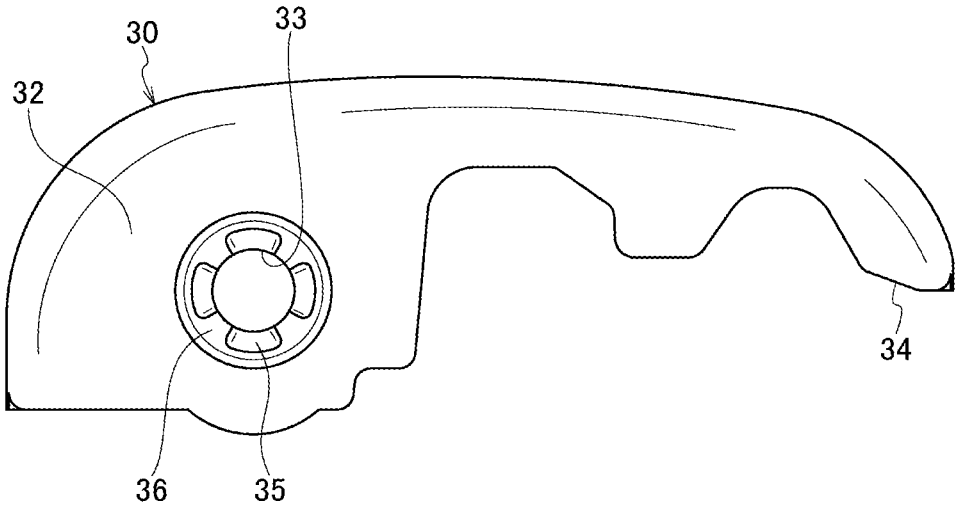
FIG. 5A is a side view of a cover.
Figure 5B:
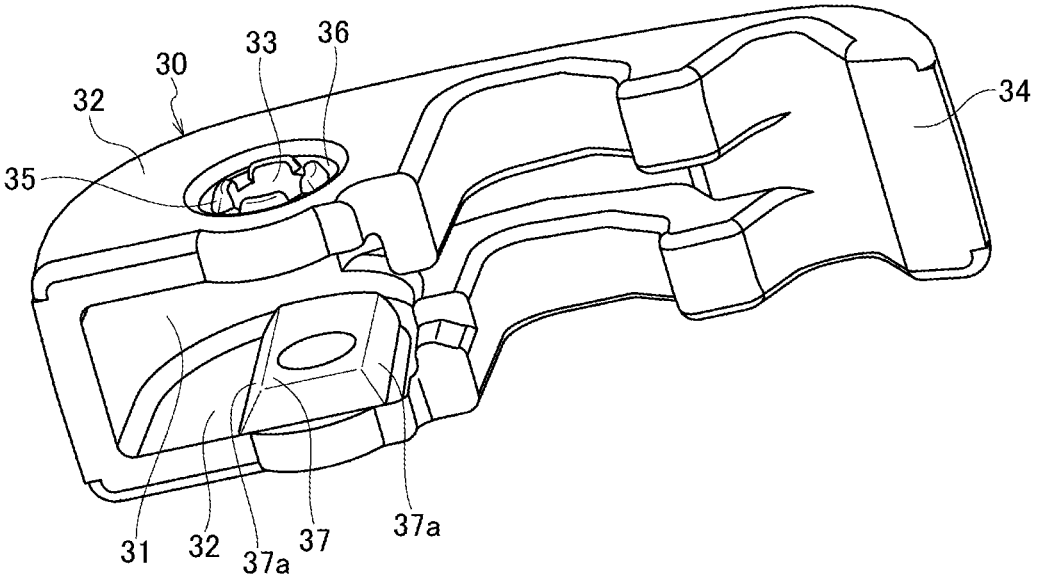
FIG. 5B is a perspective view of a cover.

As illustrated in FIGS. 2 and 3, a cover 30 having a concave shape directed downward is attached to an upper side of the upper blade 12 of the body 11 so as to extend over a position along the forward and rearward direction from the guide post 14 to the rear mouth 17, and a locking member 40 is accommodated at a position in an internal void space 31 of the cover 30 at a side of the guide post 14 to be swingable in the upward and downward direction.

The locking member 40 is inserted between a pair of attachment pieces 18 which are erected parallel with each other from the upper surface of the upper blade 12 to the guide post 14 side, and a pin 50 is inserted into a through-hole 41 of the locking member 40 and through-holes 19 of the pair of attachment pieces 18, so that the locking member 40 is swingably supported in the upward and downward direction with respect to the body 11. The locking member 40 and the pair of attachment pieces 18 are covered by the cover 30 from above, but the pin 50 is also inserted into through-holes 33 formed in lateral plate portions 32 of the cover 30, and thus the cover 30 is fixed to the body 11.

The upper blade 12 is provided at a substantially center portion thereof with a locking window hole 20 which communicates with the element guide passage 15 from the upper surface of the upper blade 12. A locking claw 42 of the locking member 40 is inserted in to the locking window hole 20, and protrudes in the element guide passage 15.

The locking member 40 is provided with an operating piece 43 which is formed above the locking claw 42 in a normal state and is lifted by an attachment shaft portion 52 of the pull tab 51. The locking member 40 is provided with an operating recess portion 44 which is formed between the locking claw 42 and the operating piece 43 and is opened toward the rear mouth 17 in an attachment state to receive the attachment shaft portion 52 of the pull tab 51 therein. Further, a first compression spring 53 functioning as an urging member is installed in a compressed state between a shoulder mouth-side bottom surface 45 of the locking member 40 and a spring retaining hole 14*a* formed in the guide post 14. The locking member 40 is pivoted by an urging force of the first compression spring 53 around the pin 50 as a fulcrum, so that the locking claw 42 is constantly urged to protrude in the element guide passage 15.

As illustrated in FIG. 3, a gap between a rear mouth-side end portion 34 of the cover 30 and the upper blade 12 is configured as an insertion gap 54 for inserting the attachment shaft portion 52 of the pull tab 51 into the operating recess portion 44 of the locking member 40. A closure member 55 for opening and closing the insertion gap 54 is slidably installed in the insertion gap 54.

As illustrated in FIG. 2, the closure member 55 is slidably mounted in a guide groove 21 formed on the upper surface of the upper blade 12 along the forward and rearward direction of the body 11. Further, a second compression spring 56 is installed in a compressed state between the end portion of the closure member 55 at the side of the guide post 14 and the spring retaining groove 22 formed in the guide groove 21, so that the closure member 55 is constantly urged toward the rear mouth 17 by the urging force of the second compression spring 56. The end portion of the upper blade 12 at the side of the rear mouth 17 is provided with a pair of stoppers 23 for preventing the closure member 55 from being released at a gap closing position in which the closure member 55 closes the insertion gap 54. As the closure member 55 is slid forward to a gap opening position in which the insertion gap is opened, and the attachment shaft portion 52 of the pull tab 51 is inserted in to the insertion gap 54, the attachment shaft portion 52 is accommodated in the operating recess portion 44 of the locking member 40.

Figure 6:
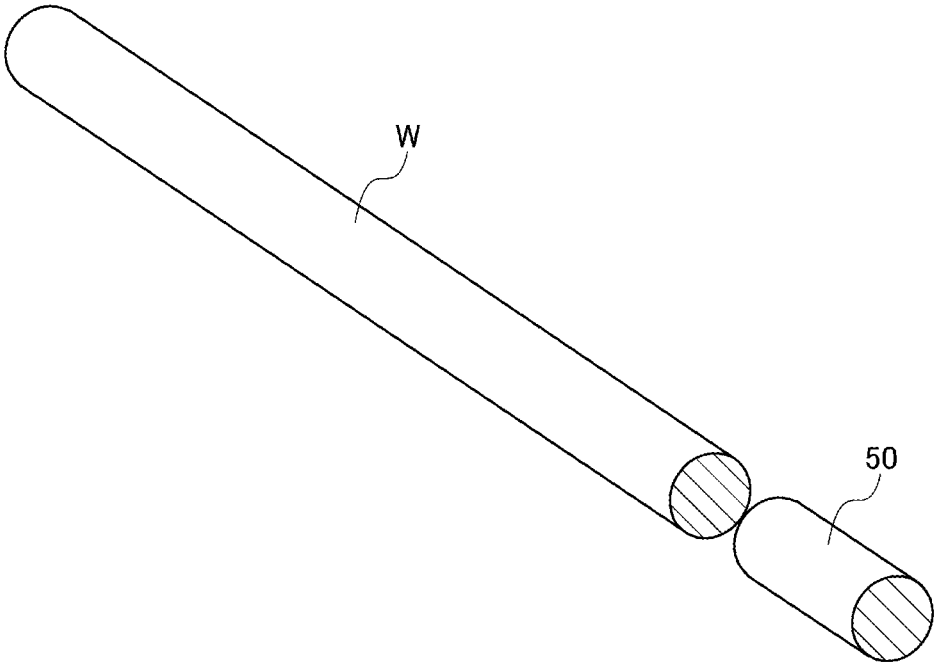
FIG. 6 is a view illustrating a process of machining a pin from a wire.

The pin 50 penetrating the through-hole 41 of the locking member 40, the through-holes 19 of the pair of attachment pieces 18, and the through-holes 33 of the pair of lateral plate portions 32 of the cover 30 is made only by cutting a wire W, as illustrated in FIG. 6. Further, since it is not necessary to carry out special machining after cutting, a hard material such as brass, various stainless steels, or magnesium alloy is used.

The pin 50 is fixed and positioned in an axial direction by crimping a plurality (four in this embodiment) of crimping protrusions 35 which are respectively provided at the peripheral portions of the through-holes 33 of the pair of lateral plate portions 32 which are disposed at both end portions of the pin 50 to cause the crimping protrusions 35 to abut against end faces 50*a* of the pin 50. The pair of lateral plate portions 32 are formed with annular recess portions 36 at the peripheral portions of the through-holes 33, and the plurality of crimping protrusions 35 are provided so as to extend in an axial direction of the through-holes 33 from the recess portions 36. In this embodiment, the crimping protrusion 35 is formed so that an inner surface thereof is continuous in the axial direction from an edge of the through-hole 33 along an inner peripheral surface of the through-hole 33. Further, an outer surface of the crimping protrusion 35 is inclined so as to be formed in a conical shape so that the crimping protrusion is gradually tapered toward a tip end thereof.

The pair of lateral plate portions 32 of the cover 30 are formed with a pair of thick-walled portions 37 which protrude inwardly in the width direction at inside surfaces thereof in the vicinity of the through-holes 33, and inclined surfaces 37*a* are formed on both end portions of the respective thick-walled portions 37 in the forward and rearward direction. Further, the pair of attachment pieces 18 of the body 11 are respectively formed with a pair of guide depression portions 24 which are recessed inwardly in the width direction, in the vicinity of the through-holes 19 of the outside lateral surfaces in the width direction. Both end portions of the respective depression portions 24 are provided with other inclined surfaces 24*a* facing the inclined surfaces 37*a* of the thick-walled portion 37. An axial length of the pin 50 is set to be longer than the gap between the pair of thick-walled portions 37, and be shorter than a distance between outer sides of the pair of lateral plate portions 32. In this embodiment, the axial length of the pin 50 is set to be approximately equal to the distance between the bottom surfaces of the pair of recess portions 36.

Accordingly, when the locking member 40 and the cover 30 are assembled to the body 11, the cover 30 is inserted until the bottom surface 38 of the cover 30 abuts against a mounting groove 25 on the upper blade 12, while the pair of thick-walled portions 37 are guided by the pair of guide depression portions 24, so that the position thereof is determined with respect to the body 11. Accordingly, the through-hole 41 of the locking member 40, the through-holes 19 of the pair of attachment pieces 18, and the through-holes 33 of the cover 30 are made to line up on a coaxial line in the state in which the opening-side lower end 45 abuts against the first compression spring 53 between the pair of attachment pieces 18, and then the pin 50 is inserted into these through-holes 41, 19 and 33. After that, as the plurality of crimping protrusions 35 of the cover 30 are crimped to abut against the end faces 50*a* of the pin 50, the locking member 40 is swingably supported by the body, and the cover 30 is fixed to the body 11. In the state in which the crimping protrusions 35 are crimped, the crimping protrusions 35 do not protrude from the outer sides of the pair of lateral plate portions 32 of the cover 30 in a plan view (see the cross-sectional view of FIG. 4).

As described above, according to the slider 10 for the slide fastener with the automatic stopper according to this embodiment, the pair of lateral plate portions 32 of the cover 30 which are disposed at both end portions of the pin 50 are respectively provided with crimping protrusions 35, which are abuttable against the end surfaces 50*a* of the pin 50, at the peripheral portions of the through-hole 33 through which the pin 50 penetrates. Therefore, as the crimping protrusions 35 are installed, the pin 50 can be locked, irrespective of the shape of the peripheral portion of the through-hole 33, like the related art. Further, since the pin is made just by cutting the wire W, secondary machining is not required, and thus a manufacture cost of the pin 50 can be decreased. Further, since the hard material is used, it is possible to manufacture a good abrasion resistant product.

In addition, since the pair of lateral plate portions 32 of the cover 30 are provided with the recess portions 36 at the peripheral portions of the crimping protrusions 35, the crimping protrusions 35 do not protrude in a lateral direction when the slider 10 is seen from a plan, in the state in which the crimping protrusions 35 are crimped. Accordingly, it is possible to prevent a fabric of an attached product from being damaged due to that the attached product is caught by the crimping protrusions 35, and to prevent the crimping protrusions 35 from being worn due to interference of the pull tab 51 after assembling. Further, since the pull tab 51 is not caught by the crimping protrusions 35 in use, the operation can be smoothly performed. Furthermore, since the crimping protrusions 35 do not protrude in the lateral direction when the slider 10 is seen from a plan, in the state before the crimping protrusions 35 are crimped, it is possible to suppress the wearing of the crimping protrusions 35 even when the cover 30 is ground.

Since the pair of lateral plate portions 32 of the cover 30 are formed with the pair of thick-walled portions 37 protruding inwardly from an inside surface thereof in the vicinity of the through-holes 33, it is possible to reinforce the portion of which the thickness is decreased by the recess portion 36, thereby ensuring the strength of the pair of lateral plate portions 32.

Furthermore, since the pair of attachment pieces 18 are respectively formed with the pair of guide depression portions 24 facing the pair of thick-walled portions 37 in the vicinity of the through-holes 19 into which the pin 50 is inserted, the position of the cover 30 with respect to the body 11 can be easily determined, and the pin 50 can be easily inserted into each through-hole 19 and 33.

Figure 7A:
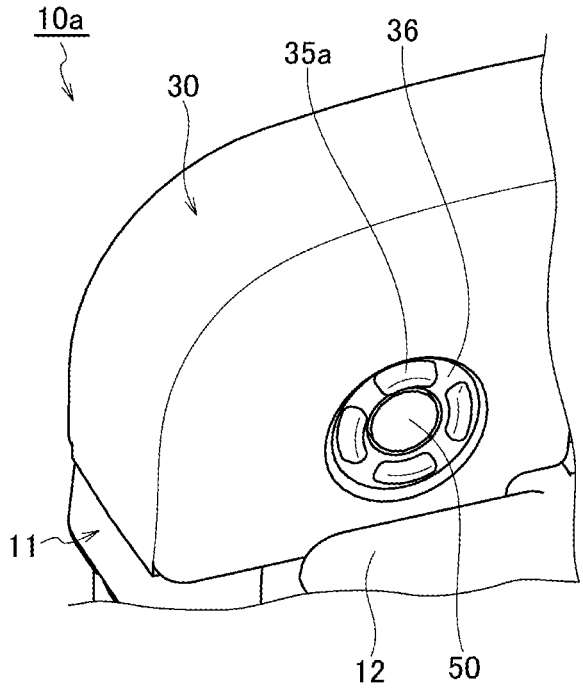
Figure 7B:
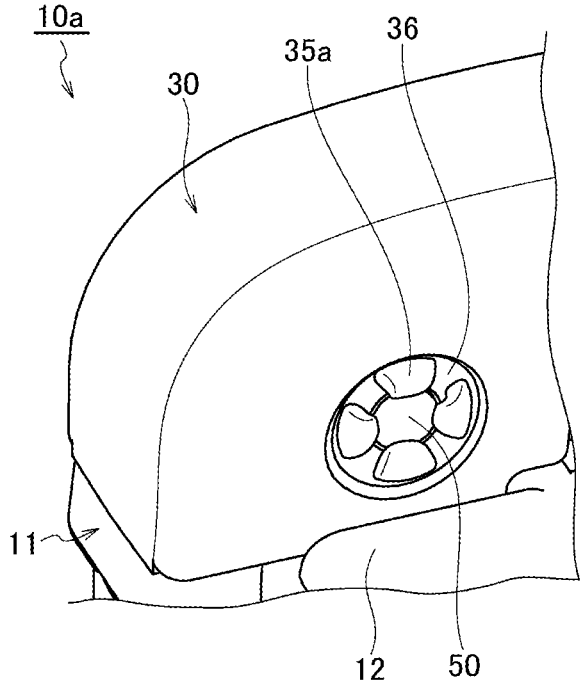
Figure 8:
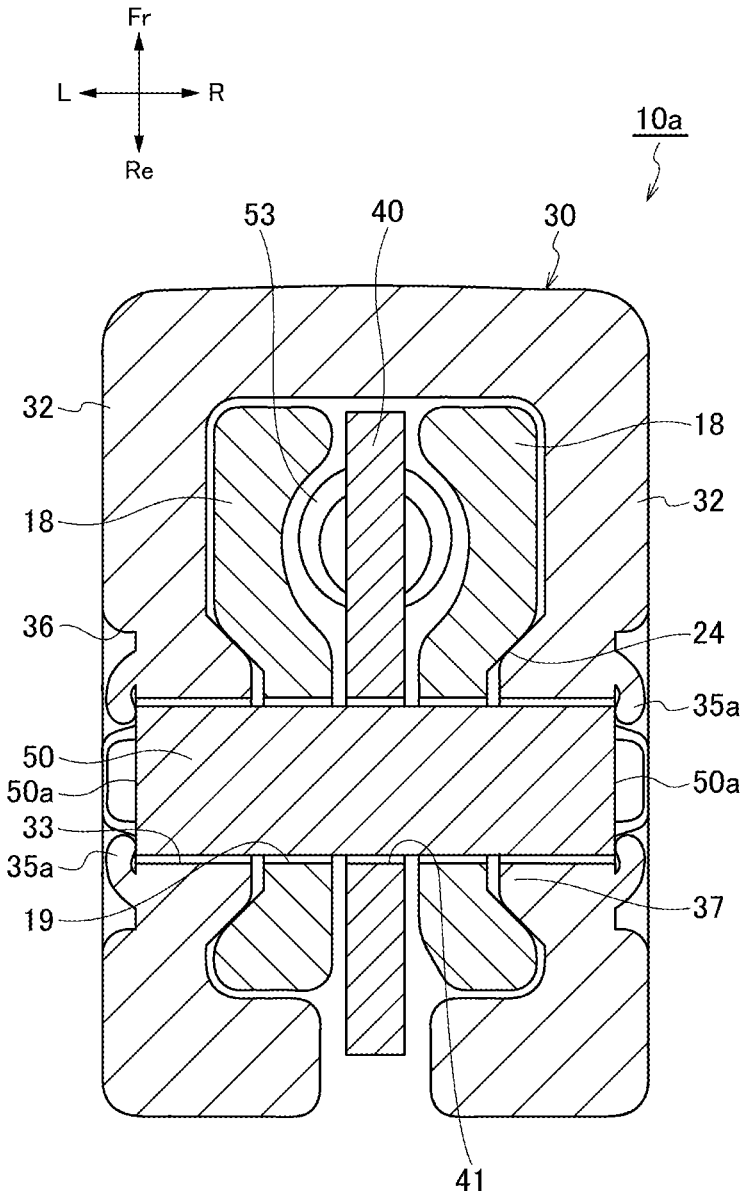
FIG. 8 is a cross-sectional view of the slider in FIGS. 7A and 7B which corresponds to FIG. 4.

FIGS. 7A, 7B and 8 illustrate a slider for a slide fastener with an automatic stopper according to a first modification of this embodiment. A slider 10*a* is different from the first embodiment in view of the configuration of crimping protrusions 35*a*.

That is, in the first modification, the crimping protrusions 35*a* are formed at the peripheral portions of the through-hole 33 so as to extend in the axial direction of the through-hole 33 from a position which is slightly spaced apart from the edge portion of the through-hole 33 of the lateral plate portion 32 to an outer side in the diameter direction of the through-hole 33. In the crimping protrusions 35*a* configured as described above, since the crimping is carried out by bending the plurality of crimping protrusions 35*a* in the inner side of the diameter direction, as illustrated in FIG. 8, the crimping protrusions 35*a* abut against the end faces 50*a* of the pin 50, thereby fixing the axial positioning of the pin 50. In particular, since the crimping protrusions 35*a* are spaced apart from the edge portion of the through-hole 33, the crimping can be carried out without deforming the shape of the edge portion of the through-hole 33.

Other configurations and working thereof are identical to those of the first embodiment.

Figure 9A:
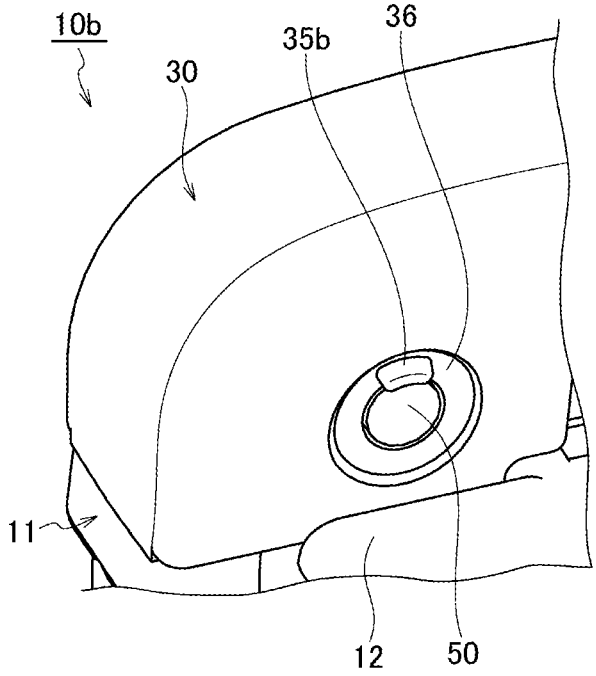
Figure 9B:
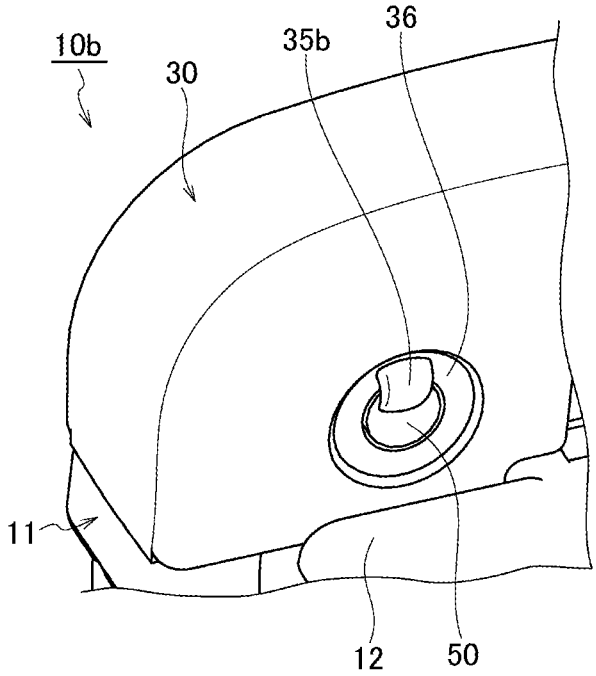

FIGS. 9A and 9B illustrate a slider for a slide fastener with an automatic stopper according to a second modification of this embodiment. A slider 10*b* is different from the first embodiment in view of the configuration of a crimping protrusion 35*b*.

That is, in the second modification, one crimping protrusion 35*b* is provided at the peripheral portion of the through-hole 33, and the crimping is carried out by bending the crimping protrusion 35*b* in the inner side of the diameter direction, thereby fixing the axial positioning of the pin 50 and simplifying the crimping process. A shaping position of the one crimping protrusion 35*b* may be installed from the edge portion of the through-hole 33, or be installed at a position slightly spaced apart from the edge portion on the outside in the diameter direction. In order to reliably fix the pin by the one crimping protrusion 35*b*, it preferably has a length to be in contact with the center portion of the pin 50.

Other configurations and working effects thereof are identical to those of the first embodiment.

Figure 10A:
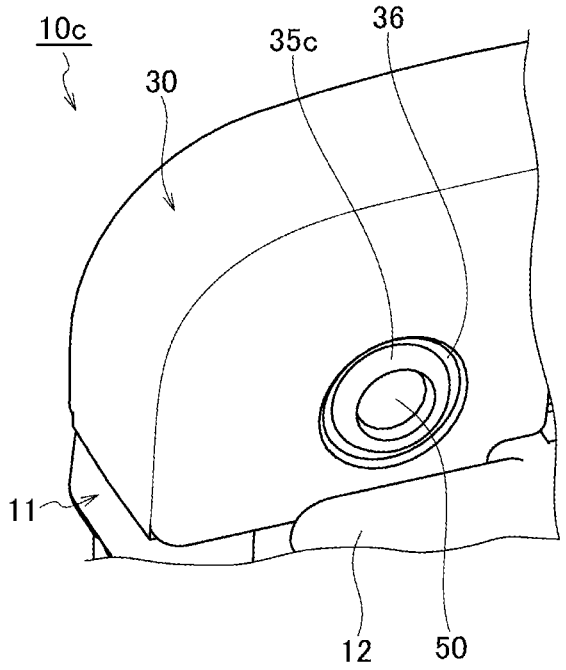
Figure 10B:
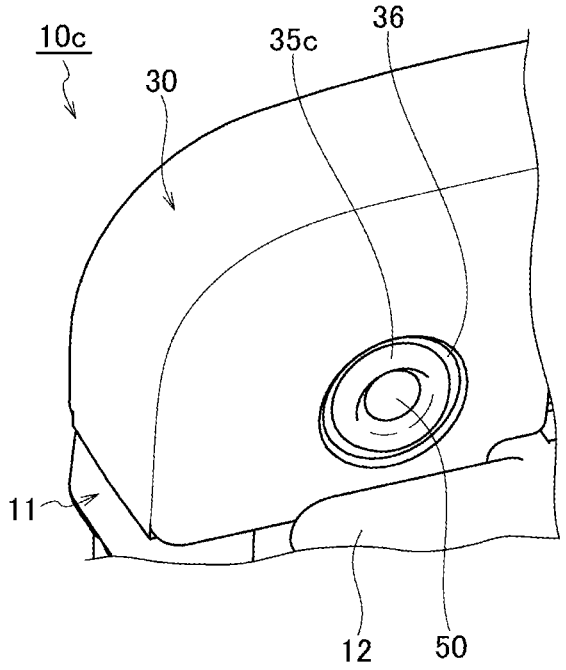

FIGS. 10A and 10B illustrate a slider for a slide fastener with an automatic stopper according to a third modification of this embodiment. A slider 10*c* is different from the first embodiment in view of the configuration of a crimping protrusion 35*c*.

That is, in the third modification, a ring-shape crimping protrusion 35*c* is provided at the peripheral portion of the through-hole 33, and the crimping is carried out by bending the crimping protrusion 35*c* in the inner side of the diameter direction, thereby fixing the axial positioning of the pin 50. A shaping position of the ring-shape crimping protrusion 35*c* may be installed from the edge portion of the through-hole 33, or be installed at a position slightly spaced apart from the edge portion on the outside in the diameter direction. Since the crimping protrusion 35*c* is in contact with the pin 50 along the overall circumference by crimping with the ring-shape crimping protrusion 35*c*, so that the pin 50 is reliably fixed.

Other configurations and working effects thereof are identical to those of the first embodiment.

Embodiment 2

Figure 11:
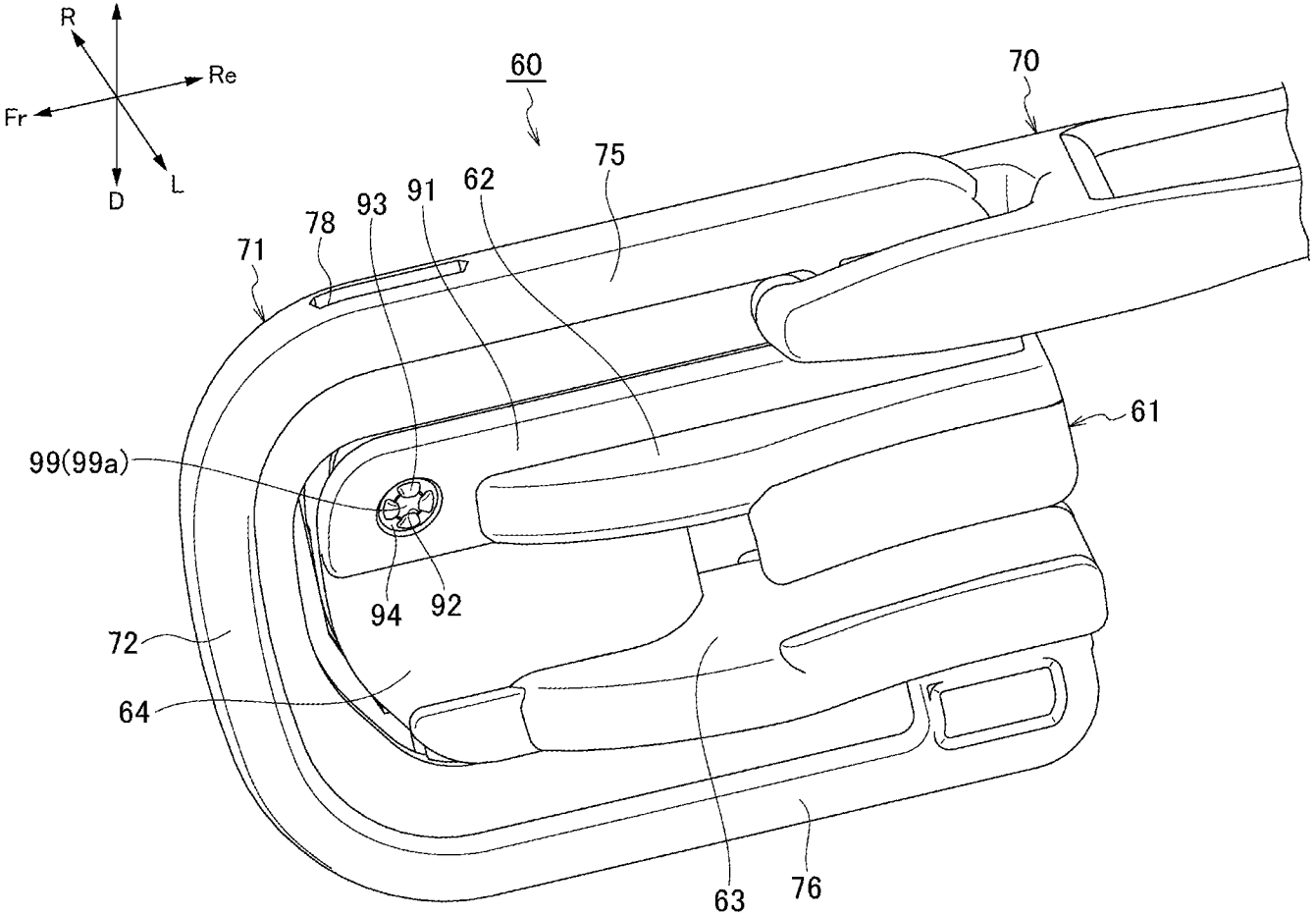
FIG. 11 is a perspective view illustrating a slider for a slide fastener with an automatic stopper, to which a pull tab is to be attached after the slider has been assembled, according to a second embodiment of the present invention.
Figure 12:
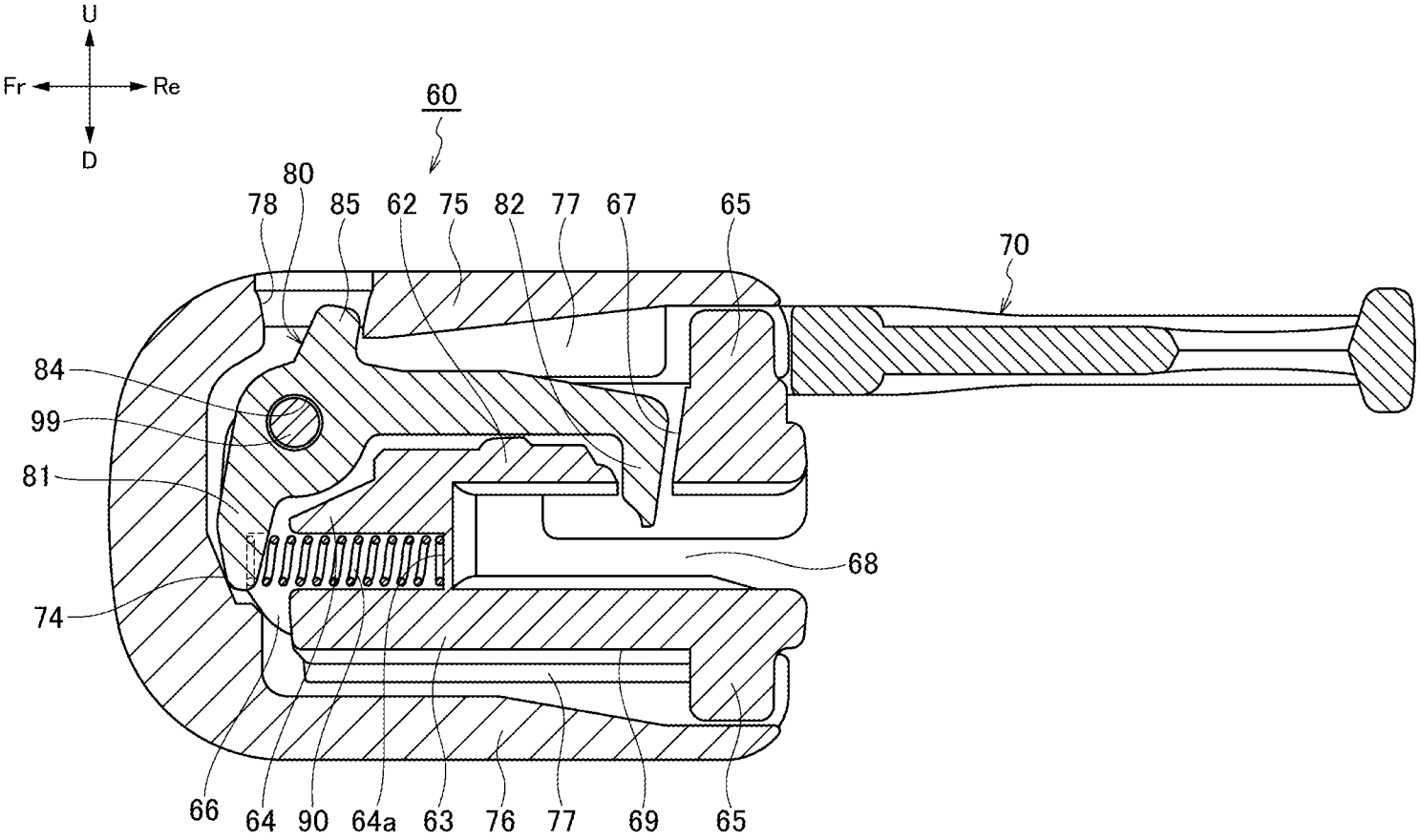
FIG. 12 is a cross-sectional view illustrating the slider in FIG. 11.

Next, a slider for a slide fastener with an automatic stopper of a reversible pull tab rotation type according to the second embodiment of the present invention will now be described with reference to FIGS. 11 to 13.

The slider 60 for the slide fastener with the automatic stopper of the pull tab rotation type (hereinafter, referred to as a slider 60) includes a U-shape guide rod 71, of which the whole is seen as U-shape, attached to a body 61 so that a pull tab 70 is pivotally movable along an upper surface, a front surface and a bottom surface of the body 61 having an upper blade 62 and a lower blade 63 which are connected to each other by a guide post 64. In this instance, as illustrated in FIG. 12, the U-shape guide rod 71 is attached in a shape enclosing an attachment post 65 so that the U-shape guide rod 71 is slightly moved forward and backward with respect to the attachment post 65 which is erected at a rear mouth side of the upper blade 62 and the lower blade 63 of the body 61. The U-shape guide rod 71 is moved by forwardly and backwardly pulling operation of the pull tab 70.

A front surface of the guide post 64 of the body 61 is provided with a recess portion 66 to receive a hook piece 81 of a locking member 80. Further, the guide post is provided at its middle portion with an insertion hole 64*a* in a horizontal direction, and a compression spring 90 is inserted into the insertion hole to press the hook piece 81 of the locking member 80. A locking window hole 67 is made at a rear mouth side of the upper blade 62 of the body 61, and a locking claw 82 of the locking member 80 is inserted into the locking window hole, so that the locking claw 82 can advance and retreat in an element guide passage 68.

The body 61 of the slider 60 and the U-shape guide rod 71 are separately formed by die-casting molding using metal such as aluminum alloy or zinc alloy, and the pull tab 70 is made by pressing a metal sheet, thereby assembling the slider 60.

Figure 13:
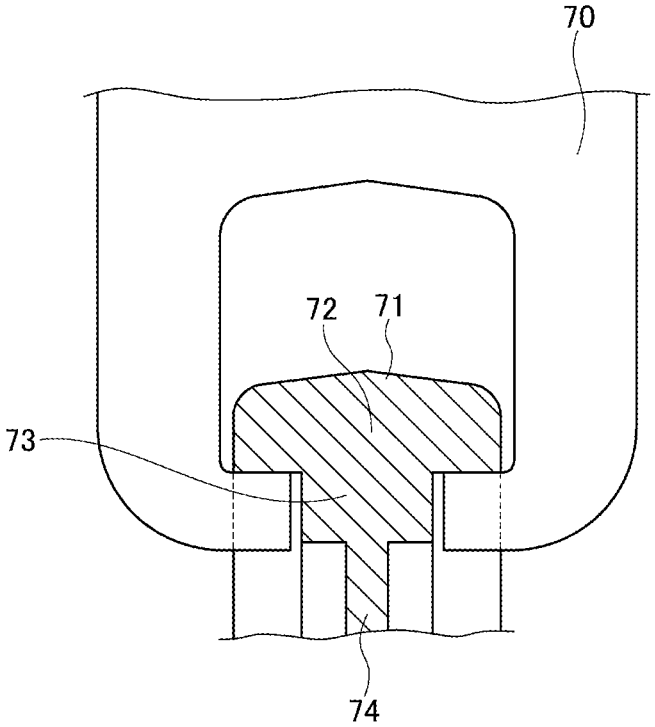
FIG. 13 is a cross-sectional view illustrating a front piece of a U-shaped guide rod of the slider in FIG. 11.

An inner surface of the U-shape guide rod 71 is formed to have a T-shape in cross section, and, for example, as illustrated in FIG. 13, a front piece 72 of the U-shape guide rod 71 disposed at the front surface of the body 61 forms a cam 74 by protruding a center portion of a T-shape pull tab guide portion inwardly. Also, an upper piece 75 and a lower piece 76 are respectively provided with a groove 77 at a center portion of a pull tap guide portion 73, in which an upper portion of the locking member 80 which is axially supported by the body 61 is inserted into the groove 77 of the upper piece 75, and a protrusion 69 protruding from a surface of the lower blade 63 of the body 61 is inserted into the groove 77 of the lower piece 76.

The locking member 80 shows a C-shape of which the whole length is long, and has a locking claw 82 at one end and a hook piece 81 longer than the locking claw 82 at the other end, the locking claw and the hook piece being installed in parallel. A base of the hook piece 81 is provided with a through-hole 84, and is swingably supported on the body 61 by a pin 99. The hook piece 81 is provided at its upper side with a protruding piece 85, and the protruding piece 85 is inserted into a long hole 78 formed in the U-shape guide rod 71 to restrict forward and backward swing of the locking member 80. When the U-shape guide rod 71 is moved forward by the pull tab 70, the protruding piece 85 is pressed and moved at an edge portion of the long hole 78 to lift the locking claw 82 in the element guide passage 68 against the resilient force of the compression spring 90. As a result, the slider 60 can be slid in a close direction.

If the slider 60 is slid in a separable direction, the U-shape guide rod 71 is moved toward the rear mouth side by the pull operation of the pull tab 70. Simultaneously, the hook piece 81 presses and compresses the compression spring 90 by the cam 74 to lift the locking claw 82 from the element guide passage 68. As a result, the slider 60 of the pull tab rotation type can be slid.

In this embodiment, the locking member 80 is axially supported on a pair of lateral plate portions 91 of the body, which are positioned at the outside in the width direction of the locking member 80, by the pin 99. Specifically, after the pin 99 is inserted into the through-hole 84 of the locking member 80 and through-holes of the pair of lateral plate portions 91 of the body 61, a plurality of crimping protrusions 93 each installed the peripheral portions of the through-holes 92 positioned at both end portions of the pin 99 are crimped, and thus the plurality of crimping protrusions 93 abut against an end faces 99*a* of the pin 99, so that the axial positioning of the pin 99 is fixed. Further, in this embodiment, the pair of lateral plate portions 91 are provided with annual recess portions 94 at the peripheral portions of the through-holes 92, and the plurality of crimping protrusions 93 extend in an axial direction from the recess portions 94.

The crimping protrusions 93 of this embodiment have the same shape as that of the crimping protrusions 35 of the first embodiment, but may be configured like the crimping protrusions 35*a* to 35*c* of the first to third modifications of the first embodiment.

Incidentally, the present invention is not limited to the above-described embodiments, and a modification or an alteration are allowed. In addition, material, shape, size, number, location or the like of each component is arbitrary and not limited as long as they can attain the present invention.

For example, the pin of the present invention is preferably a cylindrical shape like this embodiment, but an oval column or a polygonal column such as hexagonal column is available.

Figure 14:
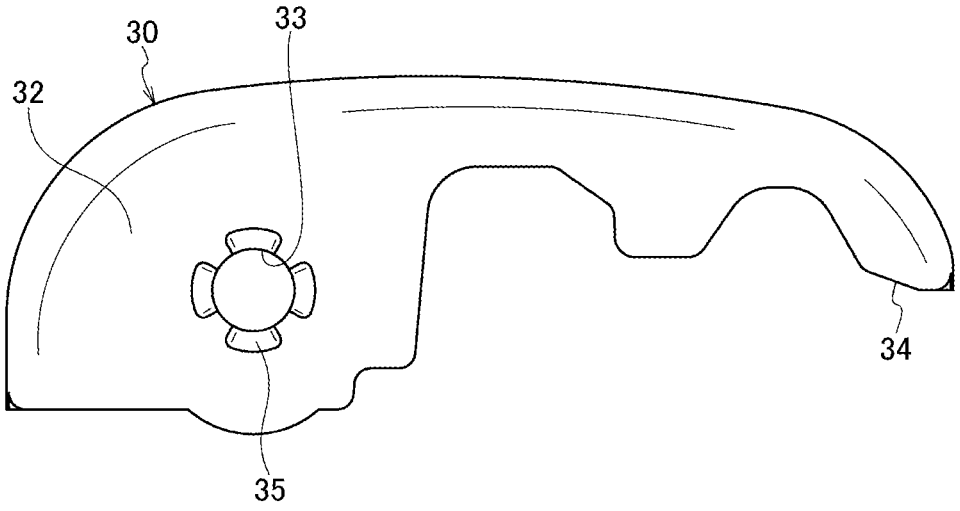
FIG. 14 is a side view of a cover to illustrate a modification of a peripheral configuration of crimping protrusions.

Further, the peripheral configuration of the crimping protrusion according to the present invention is not limited to the above embodiments as long as the crimping protrusions are crimped to abut against the end faces of the pin. For example, in the slider for the slide fastener with the automatic stopper according to the first embodiment, as illustrated in FIG. 14, the crimping protrusion 35 may be directly formed on a lateral surface of the pair of lateral plate portions 32 of the cover, without forming the recess portion. Also, the recess portions 36 formed on the pair of lateral plate portions 32 may be formed only in the vicinity of the crimping protrusions 35.

Figure 15:
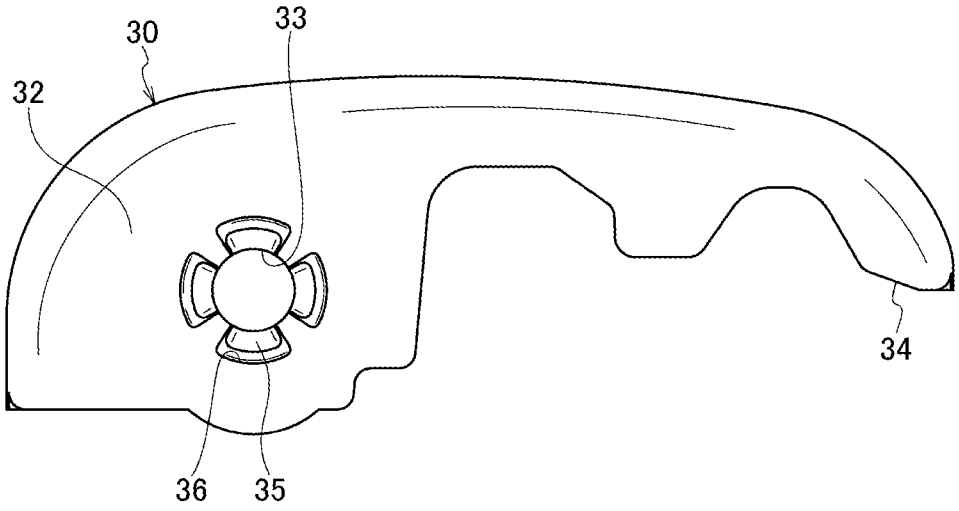
FIG. 15 is a side view of the cover to illustrate other modification of a peripheral configuration of crimping protrusions.

In this instance, the configuration of FIG. 14 or 15 may be applied to the slider for the slide fastener with the automatic stopper of the pull tab rotation type.

DESCRIPTION OF REFERENCE NUMERALS

10, 10*a*, 10*b*, 10*c*: Slider for Slide Fastener with Automatic Stopper, to Which Pull Tab Is to Be Attached after Slider Has Been Assembled
11, 61: Body
12, 62: Upper Blade
13, 63: Lower Blade
14, 64: Guide Post
19, 91: Through-Hole
20, 67: Locking Window Hole
24: Guide Depression Portion
30: Cover
35, 35*a*, 35*b*, 35*c*, 93: Crimping Protrusion
36, 94: Recess Portion
37: Thick-Walled Portion
40, 80: Locking Member
42, 82: Locking Claw
43: Operating Piece
44: Operating Recess Portion
50, 99: Pin
51, 70: Pull Tab
52: Attachment Shaft Portion
53: First Compression Spring (Urging Member)
54: Insertion Gap
55: Closure Member
60: Slider for Slide Fastener with Automatic Stopper Of Pull Tab Rotation Type
90: Compression Spring (Urging Member)

The invention claimed is:

1. A slider for a slide fastener with an automatic stopper, the slider comprising:
- a body forming an element guide passage into which fastener elements are insertable;
- a locking member swingably supported in the body by a pin, and having a locking claw which is protrudable from a locking window hole formed in the body to the element guide passage; and
- an urging member configured to urge the locking member so that the locking claw protrudes from the locking window hole to the element guide passage,
- wherein a pair of lateral plate portions disposed at both end portions of the pin are respectively provided with crimping protrusions which are abuttable against end faces of the pin and which are arranged at peripheral portions of a through-hole of the pair of lateral plate portions, through which the pin penetrates, and
- wherein the pair of lateral plate portions are formed with recess portions at the peripheral portions of the through-hole, the recess portions in which the crimping protrusions extend.

2. The slider for the slide fastener with the automatic stopper, according to claim 1, wherein the body includes an upper blade and a lower blade which are connected to each other by a guide post, wherein a cover is attached to the upper blade of the body, the cover which the pin is inserted through together with a pair of attachment pieces erected from the upper blade and the locking member and which covers the pair of attachment pieces and the locking member, and wherein the crimping protrusions are respectively provided on the pair of lateral plate portions of the cover.

3. The slider for the slide fastener with the automatic stopper, according to claim 2, wherein the pair of lateral plate portions of the cover are provided with a pair of thick-walled portions which protrude inwardly, at inside surfaces thereof in the vicinity of the through-hole.

4. The slider for the slide fastener with the automatic stopper, according to claim 3, wherein the pair of attachment pieces are respectively formed with a pair of depression portions which face the pair of thick-walled portions and which are arranged in the vicinity of a through-hole of the pair of attachment pieces, into which the pin is inserted.

5. The slider for the slide fastener with the automatic stopper, according to claim 2, wherein the cover is formed in a concave shape directed downward, wherein the locking member comprises an operating groove for accommodating an attachment shaft portion of a pull tab therein, wherein the slider comprises a closure member configured to slide between a gap opening position in which an insertion gap formed between a rear mouth-side end portion of the cover and the upper blade is opened and the attachment shaft portion of the pull tab is insertable into the insertion gap, and a gap closing position in which the insertion gap is closed, and wherein the pull tab is configured to be detachable.

6. The slider for the slide fastener with the automatic stopper, according to claim 1, wherein the crimping protrusions are directly provided on the pair of lateral plate portions of the body, respectively.

7. The slider for the slide fastener with the automatic stopper, according to claim 1, wherein the crimping protrusions are formed along edge portions of the through-hole.

8. The slider for the slide fastener with the automatic stopper, according to claim 1, wherein each of the pair of lateral plate portions is provided with at least two crimping protrusions.

9. The slider for the slide fastener with the automatic stopper, according to claim 1, wherein the crimping protrusions are formed over the whole circumferences of the through-hole.

* * * * *